US011161717B2

(12) United States Patent
Novacek et al.

(10) Patent No.: US 11,161,717 B2
(45) Date of Patent: Nov. 2, 2021

(54) MONITORING OF THE MECHANICAL CONDITION OF AN ESCALATOR OR A MOVING WALKWAY

(71) Applicant: INVENTIO AG, Hergiswil (CH)

(72) Inventors: Thomas Novacek, Schwechat (AT); Jürg Burri, Hirschthal (CH)

(73) Assignee: INVENTIO AG, Hergiswil (CH)

( * ) Notice: Subject to any disclaimer, the term of this patent is extended or adjusted under 35 U.S.C. 154(b) by 208 days.

(21) Appl. No.: 16/498,882

(22) PCT Filed: Mar. 7, 2018

(86) PCT No.: PCT/EP2018/055671

§ 371 (c)(1),
(2) Date: Sep. 27, 2019

(87) PCT Pub. No.: WO2018/177708

PCT Pub. Date: Oct. 4, 2018

(65) Prior Publication Data

US 2021/0276831 A1 Sep. 9, 2021

(30) Foreign Application Priority Data

Mar. 28, 2017 (EP) ..... 17163204

(51) Int. Cl.
*B66B 25/00* (2006.01)
*B66B 27/00* (2006.01)
(Continued)

(52) U.S. Cl.
CPC ..... *B66B 25/006* (2013.01); *B66B 27/00* (2013.01); *B66B 21/04* (2013.01); *B66B 21/10* (2013.01)

(58) Field of Classification Search
CPC ..... B66B 29/04; B66B 25/003; B66B 25/006; B66B 27/00; B66B 29/00; B66B 25/00; B66B 21/04
(Continued)

(56) References Cited

U.S. PATENT DOCUMENTS 6,606,538 B2 * 8/2003 Ponsot ..... B66B 25/00 198/322
9,346,654 B2 5/2016 Goldstein
(Continued)

FOREIGN PATENT DOCUMENTS

CN 201132723 Y 10/2008
CN 101624159 A 1/2010
(Continued)

OTHER PUBLICATIONS

International Search Report for International Application No. PCT/EP2018/055671 dated May 25, 2018.

*Primary Examiner* — James R Bidwell
(74) *Attorney, Agent, or Firm* — Knobbe Martens Olson & Bear LLP

(57) ABSTRACT

The application relates to a method for detecting and monitoring the mechanical condition of an escalator or a moving walkway with at least one revolving band and at least one detecting device. The method includes (i) preparing at least one spatial image of at least one section of the revolving band, (ii) selecting at least one region of the spatial image, (iii) comparing the selected region with at least one comparison region, wherein the comparison region is defined by three-dimensional coordinates and represents a virtual space which can be clearly assigned to the selected region, and (iv) generating an alarm signal if the selected region differs from the comparison region by surpassing predetermined limits.

14 Claims, 3 Drawing Sheets

(51) Int. Cl.
*B66B 21/10* (2006.01)
*B66B 21/04* (2006.01)

(58) Field of Classification Search
USPC ..... 198/322, 323
See application file for complete search history.

(56) References Cited

U.S. PATENT DOCUMENTS

| | | | | |
|---|---|---|---|---|
| 10,093,518 | B1 * | 10/2018 | Seki | B66B 29/005 |
| 10,954,105 | B1 * | 3/2021 | Pahlke | H04W 84/12 |
| 2007/0170037 | A1 * | 7/2007 | Kuroda | B66B 29/00 198/322 |
| 2012/0186940 | A1 * | 7/2012 | Lanzki | B66B 25/00 198/322 |
| 2013/0126297 | A1 * | 5/2013 | Lykkegaard | B65G 17/12 198/322 |
| 2013/0140134 | A1 * | 6/2013 | Senger | B66B 29/005 198/322 |
| 2018/0306832 | A1 * | 10/2018 | Liu | B66B 25/006 |

FOREIGN PATENT DOCUMENTS

| | | | |
|---|---|---|---|
| CN | 104909255 | A | 9/2015 |
| DE | 102012109390 | | 4/2014 |
| EP | 1013599 | A1 | 6/2000 |
| JP | 2009190818 | | 8/2009 |
| JP | 2010269883 | A | 12/2010 |
| JP | 2010269884 | | 12/2010 |
| JP | 2015168551 | A1 | 9/2015 |
| KR | 920007689 | U | 10/1992 |
| TW | 201534549 | A | 9/2015 |
| WO | WO0214200 | A1 | 2/2002 |
| WO | WO2007031106 | A1 | 3/2007 |
| WO | WO 2009101148 | A1 | 8/2009 |
| WO | WO 2015090764 | A1 | 6/2015 |

* cited by examiner

MONITORING OF THE MECHANICAL CONDITION OF AN ESCALATOR OR A MOVING WALKWAY

TECHNICAL FIELD

The application relates to a method for detecting and monitoring the mechanical condition of an escalator or a moving walkway as well as an escalator or a moving walkway having at least one detection device for detecting and monitoring the mechanical condition.

SUMMARY

It is generally known that escalators and moving walkways are provided with detecting devices for detecting and monitoring the mechanical condition in order to ensure a safe operation of these passenger transport installations. For example, CN 201132723 Y discloses an escalator, the step band of which is monitored by means of sensors. If a step has detached from the step band, this results in a gap which the sensor detects an outputs a corresponding signal to the escalator controller. The escalator controller stops the step band immediately upon receipt of the signal.

Also, JP 2010269884 A discloses an escalator having a detection device for detecting and monitoring the mechanical condition of the step band. Here, images of escalator steps are captured and evaluated by means of two cameras.

In JP 2009190818 A, the gap between the step band and the base skirt panel is monitored by means of a plurality of sensors.

However, a high monitoring density, or more precisely, monitoring as many critical locations of the escalator or moving walkway as possible requires a high number of sensors. This has the disadvantage that such a detection device is very expensive and that, in particular with each additional sensor, the susceptibility of the entire system or of an escalator or a moving walkway having a high monitoring density increases.

Thus, an object of the disclosure is to provide a method and a detection device for detecting and monitoring the mechanical condition of an escalator or a moving walkway which enable a high monitoring density, with the detecting device still being cost-effective and ensuring a high operational safety and availability of the escalator or the moving walkway.

This object is achieved by a method for detecting and monitoring the mechanical condition of an escalator or a moving walkway with at least one revolving band and with at least one detecting device. The method includes at least the following method steps which are carried out by the detecting device:

- creating at least one spatial image of at least one section of the revolving band,
- selecting at least one region of the spatial image,
- comparing the selected region with at least one comparison region, this comparison region being defined by three-dimensional coordinates and representing a virtual space that can be clearly assigned to the selected region, and
- generating an alarm signal if the selected region differs from the comparison region by surpassing predetermined limits.

Since in the present method the positions of points, areas and edges of a spatial image are compared with a virtual space, a precise and thus fail-safe monitoring depends on how the image and the comparison region are brought in a spatial relationship with one another.

A simple and precise assignment of the comparison region to the selected region is carried out according to the disclosure via reference marks. The reference marks are assigned to fixed components of the escalator or the moving walkway. Accordingly, the reference marks can be identified as reference mark image in the spatial image. In practice, a mark is arranged on a fixed region, for example, on the truss or on a guide rail of the revolving band, or this region has a construction-related distinctive feature such as a distinctively projecting screw head. In the comparison region, for example, there is also provided a reference mark, hereinafter referred to as virtual reference mark, which is defined by spatial coordinates. Now, the assignment is very simple since the virtual reference mark and the reference mark image can be used as zero points of the spatial coordinate systems of the image and the comparison region.

Thanks to this method of generating a spatial image of the current actual condition, comparing it with an assigned virtual space and analyzing it, a high number of critical locations can be monitored simultaneously with a single detecting device.

The disclosure is based on the knowledge that most of the safety-critical or damage-related incidents regarding an escalator or a moving walkway come along with a spatial displacement of moving components from their intended direction of movement or path of movement. Specifically, this concerns in particular the revolving step band of an escalator or the revolving pallet band of a moving walkway as well as the revolving handrails and handrail belts or link handrail bands, respectively, arranged laterally of and parallel to the step band or pallet band. For reasons of better readability, these components, which are movable in a revolving manner relative to fixed parts of the escalator or the moving walkway, are referred to hereinafter as revolving band.

Fixed parts of the escalator or the moving walkway comprise, for example, the supporting structure and truss, respectively, as well as components arranged stationarily therein, such as, for example, frames, guide rails, trim parts of the balustrade base and the like.

Below are some examples where imminent safety-critical events and/or imminent damage events can be detected due to a spatial displacement of movable components from their intended direction of movement. These events are not to be understood as a definitive list. There is still a plurality of other reasons which may result in a spatial displacement of moveable components from their intended direction of movement.

The first possible event relates to the lowering or raising of, for example, a left side relative to the right side of the tread of a step or a pallet. In other words, the tread is inclined transverse to the direction of travel. The reasons for this incline can be, for example, a broken step axle, a diameter decrease due to abrasion, or breakage of a drag roller or chain roller, a broken step cheek or pallet cheek, damage to a step bushing, breakage of a connection between the pallet or step to the chain of the step band or pallet band, or an enlargement of the chain roller or drag roller due to build-up of dirt on the tread thereof. However, it is also possible that a guide rail has lowered.

Excessive incline of the tread is disturbing not only for the user of the escalator or the moving walkway, it may also result in a collision of the tread with the comb plate or cause damage to the guide rails and base skirt panels.

In order to detect the incline of the tread, the spatial position of the lower edges of the side cheeks of steps and pallets can be monitored. Here, these lower edges are selected from the spatial image and compared with a comparison region. Strictly speaking, the spatial coordinates of captured points of the selected region of the spatial image are compared with spatial coordinates that can be retrieved from an electronic data storage. Through the comparison, their spatial deviation from one another is determined. It is important in this context that the comparison region can be clearly assigned to the selected region. This assignment is described in more detail below.

As soon as the spatial deviation of the selected region surpasses a specified virtual space defined by limit values or, respectively, the selected region projects beyond this virtual space, it can be assumed that the event to be monitored, in the present example an incline of the tread, has occurred. That means that an excessive incline surpassing the limit value is detected and that an alarm signal is being generated by the detecting device. This alarm signal can trigger different actions. The alarm signal can be transmitted to a controller of the escalator, which then stops the revolving band. The detecting device, for example, may also have an optical and/or acoustic output device that warns the user.

If a whole tread element is missing, the regions to be selected are missing on the spatial image as well and thus the spatial coordinates of the selected region, which, when comparing with the comparison region, results in a maximum deviation or surpassing of the limit value. In this case, the controller of the escalator or the moving walkway has to immediately initiate an emergency braking and stop the step band or pallet band.

The drag roller or chain roller of the step band or pallet band can also be selected from the spatial image and monitored accordingly. If a drag roller or chain roller is missing or the outer diameter thereof is too large, this selected region (for example, a cylindrically defined virtual space) does not match the comparison region that is retrieved from the data storage and is clearly assigned to the selected region.

Thus, those regions are preferably selected from the spatial image that have particularly great deviations from the corresponding comparison region during an event to be monitored and therefore represent a distinctive surface or edge for this possible event.

The second possible event relates to the incline of a tread surface. Although in this event the tread surface of the tread element is arranged horizontally, the side cheeks of the pallet or step are not parallel to the balustrade base and the base skirt panel thereof, or, respectively, the front and rear edges of the tread surface are not perpendicular to the base skirt panel. The reasons for this incline may be a defective step bushing on the left or the right. It is also possible, that the chain length of one of the conveyor chains is greater on one side of the step band or pallet band than on the other side due to asymmetric wear. Also, a broken connection (step axle) between the step or pallet and the conveyor chain, or defective sliding blocks which keep the step band or pallet band at a defined distance to the base skirt panel may likewise result in an incline of the tread surface.

In order to detect the tread surface, for example, the spatial position of the side cheeks or the front edge or the rear edge of the tread surfaces of steps and pallets can be monitored. In doing so, these regions are selected from the spatial image and compared with an assignable comparison region.

However, not only regions of the revolving band are imaged on the spatial image but also stationary parts, such as a section of the base skirt panel or the guide rails. For checking purposes, distances and angular positions, or parallelisms of the side cheeks, or the front edge or the rear edge of the tread surfaces of steps and pallets can be measured with respect to these stationary parts and can be evaluated based on the comparison region that can be retrieved from the data storage.

The third possible event relates to a so-called tilting of steps, as described in detail in KR 920007689 U. Due to a defect, there is more backlash between the guide rails and the step. Before the user leaves the step band and steps onto the comb plate, he/she has to perform a step. In doing so, the user steps onto the front edge of the step (edge between tread surface and riser surface) whereby the rear edge can stand up due to the larger backlash in the system and then abuts against the comb plate. The larger backlash normally is a result of wear in the step chains, on chain pins, on step axles, step bushings and step eyes of the steps.

In order to detect a upward tilting of the tread surface, for example, the spatial position of the front edge or the rear edge of the tread surfaces of treads and pallets can be monitored. In doing so, these regions are selected from the spatial image and compared with an assignable comparison region.

The fourth possible event relates to the detection of an increase of the gap between a step or pallet and the base skirt panel. This critical region, in which many accidents occur due to shoes, fingers, garments, etc. getting trapped, is situated between the stationary balustrade base and the moving steps or pallets. Specifically in the case of escalators, in the transition region from the inclined region to the horizontal region where, in addition, the steps move vertically relative to one another, objects such as, for example, shoes made of soft foam material, such as PCCR (Proprietary closed-cell resin) can be pulled in. The gap between the steps and the base skirt panel should ideally be 3 mm. In the case of a shoe/garment/finger getting trapped, the gap will be increased. The increase of the gap, and/or the foreign parts (shoes, garments, etc.) as well as a displacement of the step band or pallet band from the left side to the ride side (or vice versa) and the bending of the base skirt panel can be seen on the spatial image. This possible event can be captured, for example, by monitoring the spatial position of the side edges of the tread surfaces of steps and pallets. In doing so, these regions are selected from the spatial image and compared with an assignable comparison region. As soon as a deviation is detected, for example, an alarm signal is output to the escalator controller and the latter stops the escalator immediately, before any further pulling-in or separating of parts of objects at the comb plate occurs.

The fifth possible event relates to the transition from tread surface to tread surface (gap between two tread surfaces). As soon as there are garments or other things are located in the gap between the tread surfaces, they are imaged on the spatial images. When selecting the surfaces of the edge regions of the tread surfaces, this selected region of the spatial image deviates from the assigned comparison region in terms of shape and position, and the problem is identified.

The sixth possible event relates to the hand rail tension of the revolving handrail or of this revolving band. Here, the detecting device is arranged such that a section of the handrail return travel is also captured. If the handrail is to be monitored, the detecting device, for example, in the case of an escalator, is preferably arranged in the lower transition region from the horizontal section to the inclined section since there, due to gravity and the arrangement of the handrail drive in the upper transition region, a sag of the revolving band occurs first. A slight sag is necessary because otherwise the revolving band is tensioned too much and has high wear. With a tension that is too low and a correspondingly great sag there is a risk that the friction between the handrail and the revolving band is too low. The sag captured on the spatial image is evaluated, for example, based on a selected arched longitudinal edge of the handrail belt which has to be within the limits predetermined by the comparison region.

With a suitable arrangement of the detecting device, the aforementioned possible events can all be detected or monitored at the monitoring time by means of a single spatial image of the detecting device by selecting corresponding regions and comparing them with the assignable comparison regions. In doing so, individual selected regions or individual distinctive areas and edges such as, for example, the lower edges of step cheeks are of multiple benefit since a plurality of possible events can be checked by comparing them with the comparison region.

Suitable as a selected region is a distinct surface or distinctive edge of a tread element or a handrail section of the revolving band. Their spatial position with respect to the zero point in the spatial image is compared via the zero point of the comparison region with the predetermined limits of their target position. Due to the predetermined limits (permissible deviations), the comparison region is always a virtual space in which the spatial arrangement or position of a point, an edge or a surface of the spatial image is determined.

The predetermined limits of the comparison region are surpassed if the selected region projects at least at one location beyond the virtual space of the comparison region. If edges or surfaces are missing in the selected region, this is also considered as a surpassing of the predetermined limits. The same applies to edges or surfaces of the selected region which, by surpassing a predetermined angular tolerance limit, are not arranged parallel to corresponding edges or surfaces of the virtual space.

It goes without saying that during the operation of an escalator or a moving walkway, spatial images are repeatedly captured and evaluated with the aforementioned detecting device so as to achieve a sufficient operations monitoring. The chronological sequence of the individual images and the number of images per unit time complies with the regulations and standards of the legislature, the needs of the operators and the monitoring objective. Thus, for example, during the downtimes of the escalator or the moving walkway, no image can be taken and evaluated, during a so-called silent running (without load and with reduced speed), four images per hour can be taken and evaluated, and at nominal speed, one image per minute can be taken and evaluated. Preferably, the detecting device is controlled such that during a full revolution of the revolving band, the entire band is imaged on images. Selecting and comparing may also be very different for the individual regions of an image. Thus, for example, the position of the tread elements may be compared with the comparison region for each image while the sag of the handrail belt is checked only every hundredth image.

Also, it is not absolutely necessary to evaluate each spatial image or to compare all selected regions with the comparison region. For example, it is also possible to prepare a series of spatial images of the section of the revolving band and, by comparing the distances of surfaces and edges captured on the spatial images to at least one reference mark image, to select the spatial image that matches best the assigned comparison region and the virtual reference mark thereof, and to compare it with at least one selected region of this spatial image. Thereby, where applicable, a correction of the spatial image may be unnecessary because the regions selected from the best matching spatial image have at least approximately the same position with respect to the reference mark image as the assigned comparison region to the virtual reference mark.

In order to be able to further reduce the required computing power, it is advantageous if the reference mark image is always imaged at approximately the same location of each spatial image. In order to achieve this, a position determining device arranged on fixed components of the escalator or the moving walkway can be provided. The position determining device detects distinctive surfaces, edges or marks of a tread element or a handrail section of the revolving band. As soon as a detection takes place, the position determining device generates a trigger for triggering the imaging device depending on the current position of the detected surfaces, edges or marks relative to the position determining device. Thereby, the images of, for example, tread elements to be captured of the revolving band are always prepared in the same position relative to the fixed components of the escalator, in this example. In other words, the images show different tread elements, but they have all been captured at approximately the same location with respect to the co-imaged fixed components. Thus, only a very minor correction has to be made, or a comparison with the comparison region can take place directly if a sufficient positional deviation is determined through a position comparison of virtual reference mark and reference mark image. Accordingly, the correction of distortions due to different camera angles of the spatial image with respect to the comparison region required in case of an excessive positional deviation can be dispensed with.

Preferably, the detecting device comprises an electronic processing unit. Through the latter, for example, the selection of the region of the spatial image as well as the assignment to the comparison region can be carried out. This processing unit can also comprise an analysis unit. By means of the analysis unit, the position of surfaces or edges of the selected region relative to the limits of the comparison region can be analyzed and a positional reserve can be determined. Based on the determined positional reserve and/or by an analysis of a history of a plurality of previously determined and stored positional reserves, the next maintenance date can be determined. Thereby, imminent damages, which can be the reason for serious consequential damages, are detected early and their development is monitored.

From a positional reserve that is classified by the analysis unit as being maintenance-relevant, the work steps likely to be carried out and the maintenance material likely to be needed for maintenance can be determined. Where applicable, this can be carried out automatically, for example, by the analysis unit.

The comparison region can be generated in various ways and can be stored in a data storage of the detecting device or in a controller of the escalator or the moving walkway. However, the comparison region can also be stored in an external data storage such as, for example, a USB stick, an external hard drive, a mobile phone, a data base retrievable via Internet or in a cloud of the World Wide Web and can be retrieved from these storage media as needed.

For generating and storing the comparison region, for example, a learning movement with a bounding volume element representing the maximum permissible deviations can be carried out and the spatial image thereof can be stored in one of the aforementioned data storages.

Of course, the comparison region as well as the components of the escalator or the moving walkway can also be designed using a 3D CAD system and stored in the data storage.

There is also a possibility to carry out a learning movement with the revolving band provided for the operation and to prepare a spatial image of a region of the band. Thereafter, a comparison region is generated from this spatial image in that by adding limit values in the form of three-dimensional coordinates to distinctive edges and surfaces of the spatial image, a virtual space, that is larger by the limit values, is defined as comparison region.

Further, for checking the functionality of the detecting device, a test movement with at least one test element can be carried out. The test element is configured such that it can be installed either instead of a section of the revolving band (for example, instead of a step) or is designed as an attachment part for temporary attachment on the revolving band (for example, as attachment sleeve for the handrail belt). This test element is dimensioned such that it projects at least at one location beyond the comparison region. Accordingly, the detecting device has to output an alarm signal when the spatial image of the test element has been evaluated by selecting and comparing.

For carrying out the above described method for detecting the condition, an escalator or moving walkway with a band arranged in a revolving manner and with at least one detecting device for detecting and monitoring the mechanical condition is provided. The detecting device comprises at least one image capturing device through which spatial images can be generated. The spatial image according to the present document is to be understood as a virtual 3D model. More precisely, this spatial image is a three-dimensional representation in digital form of the captured structure that is as true to scale as possible, wherein the individual points of the spatial image in the virtual space are defined by coordinates in three dimensions and/or by vector coordinates.

Through the detecting device, the condition of the revolving band and/or the arrangement of sections of the band relative to fixed components of the escalator or the moving walkway can be detected in that at least one spatial image of a section of the revolving band is generated. Distinctive surfaces or edges of the section captured on this image can be selected by a processing unit of the detecting device and compared with a three-dimensional comparison region stored in a data storage. If the selected region differs from the comparison region by surpassing predetermined limits, an alarm signal is generated by the detecting device.

As already mentioned, the detecting device can comprise a position determining device which is arranged on fixed components of the escalator or the moving walkway and through which distinctive surfaces, edges or marks of a tread element or a handrail section of the revolving band can be detected. By means of the position determining device, a trigger for triggering the image capturing device can be generated depending on the current position of the detected surfaces, edges or marks relative to the position determining device.

The detecting device or the image capturing device can be arranged between a forward travel of the revolving band and a return travel of the revolving band. The detecting device may also include a plurality of image capturing devices which are distributed over the length of the escalator or the moving walkway, preferably in the region of neuralgic points of the escalator or the moving walkway.

Usually, a lot of dirt accumulates in escalators and moving walkways during operating phases. Dirt may also adhere to the image capturing device. When the layer of dirt becomes too dense, this may cover and affect both, the transmitting device, for example, the laser of a laser scanner, as well as the receiving device, for example, a photocell of the laser scanner. Thus, the image capturing device can be provided with a transparent protective cover that spans over the transmitting device and the receiving device. Moreover, the detecting device may include a cleaning device by means of which at least a partial surface of the transparent protective cover is cleaned periodically.

It should be noted, that some of the possible features and advantages of the disclosure are described herein with reference to different embodiments. In particular, some features are described with reference to a method according to the disclosure and other features are described with reference to a device according to the disclosure. Those skilled in the art will appreciate that the features can suitably be combined, adapted or exchanged so as to arrive at further embodiments of the disclosure.

BRIEF DESCRIPTION OF THE DRAWINGS

Hereinafter, embodiments of the disclosure are described with reference to the accompanying drawings, wherein neither the drawings nor the description are construed as limiting the invention.

The Figures are merely schematically and are not true to scale. Same reference signs indicate same or functionally identical features.

DETAILED DESCRIPTION

Figure 1:
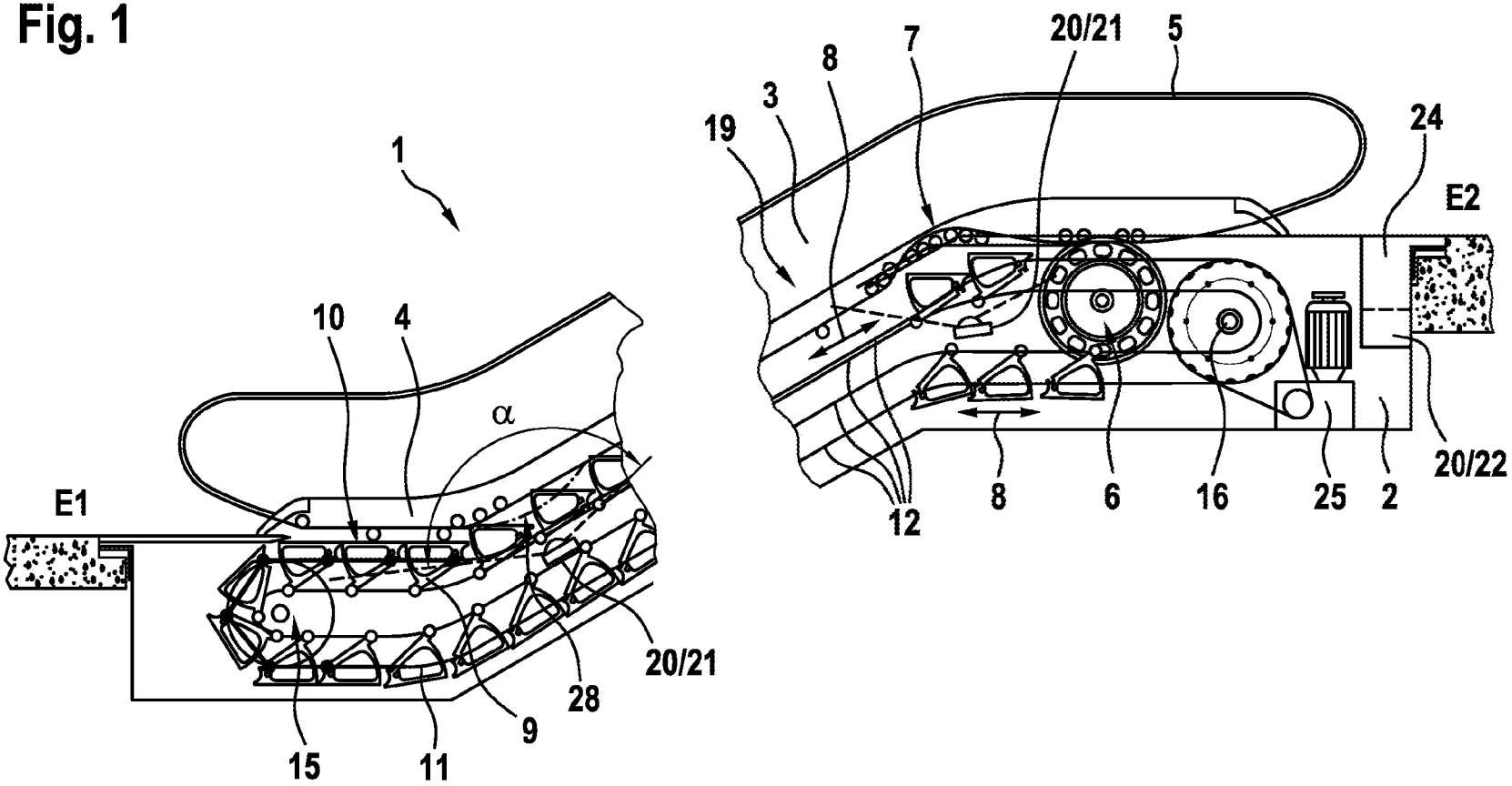
FIG. 1 shows an escalator comprising a detecting device according to an embodiment of the present disclosure.

FIG. 1 shows a side view of an exemplary escalator 1 by means of which persons can be transported, for example, between two levels E1, E2. The escalator 1 has a supporting structure 2 in the form of a truss, which, for the sake of clarity, is illustrated only by contour lines thereof. The supporting structure 2 accommodates components of the escalator 1 and supports them within a building. These components include, for example, balustrades 3 (only one is shown due to the side view), which comprise a handrail 5 arranged in a revolving manner. The balustrades 3 are connected to the supporting structure 2 via balustrade bases 4. The handrail 5 or, respectively, this revolving band 5 is driven via a friction drive 6 which is operatively connected with a drive arrangement 25 of the escalator 1. The correct tension of the handrail 5 is maintained by means of a schematically illustrated handrail tensioning device 7.

The escalator 1 further includes two annularly closed revolving conveyor chains 11, wherein only one of them is shown due to the side view. The two conveyor chains 11 are composed of a plurality of chain links. The two conveyor chains 11 can be displaced along a travel path 8 in travel directions. The conveyor chains 11 run parallel to one another and are spaced apart from one another in a direction transverse to the travel direction. In end regions adjoining the levels E1, E2, the conveyor chains 11 are deflected by deflection sprockets 15, 16.

Between the two conveyor chains 11 there are arranged a plurality of tread elements 9 in the form of tread steps connecting the conveyor chains 11 to one another transverse to the travel path 8. The tread steps 9 can be moved in the travel directions along the travel path 8 by means of the conveyor chains 11. The tread elements 9 guided on the conveyor chains 11 form a step band 10 or, respectively, a revolving band 10 in which the tread elements 9 are arranged one behind the other along the travel path 8 and can be stepped on by users in at least one conveying region 19. The revolving band 10 is guided by schematically illustrated guide rails 12 and supported against gravity. These guide rails 12 are arranged stationarily in the supporting structure 2.

In order to be able to displace the conveyor chains 11, the sprockets 16 of the upper level E2 are connected to the drive arrangement 25. The drive arrangement 25 is controlled by a controller 24 (which is shown schematically only in FIG. 1). The revolving band 10 together with the drive arrangement 25 and the deflection wheels 15, 16 form a conveyor system for users and objects, the tread elements 9 of which can be displaced relative to the supporting structure 2 that is stationarily and fixedly anchored in the building.

As already mentioned above, most of the safety-critical and/or damage-relevant events regarding an escalator 1 or a moving walkway are accompanied by a spatial displacement of moving components from their intended direction of movement. Thereby, imminent damages can be detected in particular by monitoring the revolving bands 5, 10, such as the step band 10 or the revolving handrails 5. In order to achieve this, a detecting device 20, which, in the present example, comprises two image capturing devices 21 and a processing unit 22, is arranged in the escalator 1. The image capturing devices 21 are arranged stationarily on the structure 2 in the transition regions between the horizontal sections of the escalator 1 arranged on the levels E1, E2 and the inclined middle part of the escalator 1. Since in particular the forward travel of the step band 10 loaded by the user is to be monitored and analyzed, the image capturing devices 21 are arranged between the forward travel and the return travel of the step band 10 or, respectively, the revolving band 10. The image capturing devices 21 comprise a detection field a that is limited for technical reasons and that is schematically illustrated in FIG. 1 by dotted lines and the angle $\alpha$. Accordingly, the image capturing device 21 can only detect a section of the revolving band 10.

The image capturing device 21 arranged in the transition region of the lower level E1 can also detect a sag 28 of the handrail 5. The sag results from an insufficient tension of the handrail 5 by the handrail tensioning device 7 and the gravity at exactly this location.

The two image capturing devices 21 communicate with the processing unit 22 which is arranged in the control cabinet of the controller 24 and is connected thereto. Of course, the detecting device 20 may also comprise an image capturing device 21 and a processing unit 22 which are arranged in a common housing. It is also possible that the processing device 22 is implemented as a pure software application in a computing unit and in a data storage of the controller 24. Of course, there are still further possibilities to arrange the individual parts of the detecting device 20 in the escalator 1 in a decentralized manner.

Figure 2A:
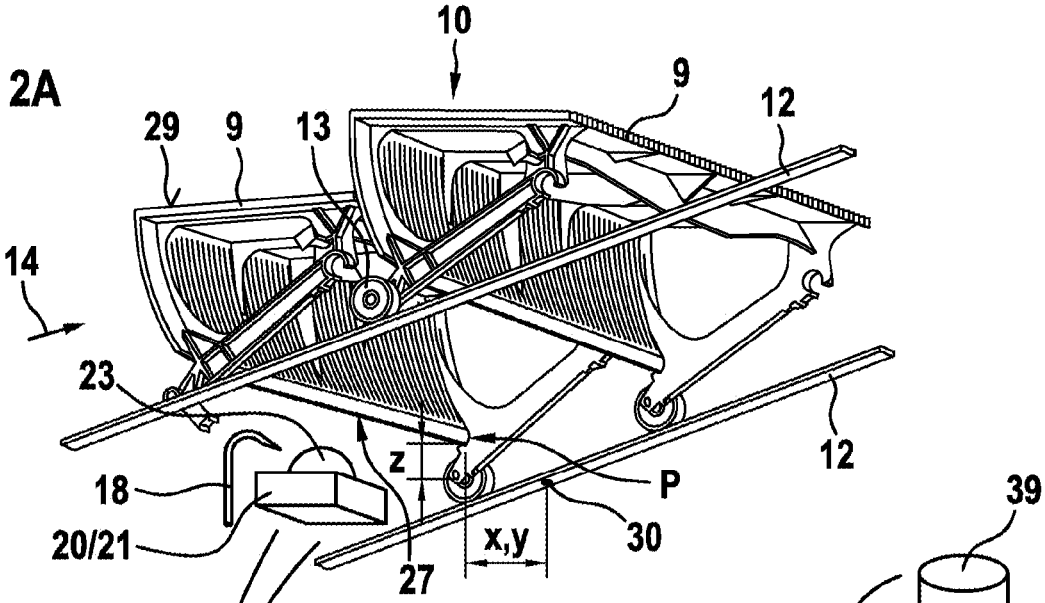
FIG. 2 schematically shows in the detail FIGS. 2A to 2C the main method steps of the method according to an embodiment of the present disclosure, as well as the operating principles of the detecting device.
Figure 2B:
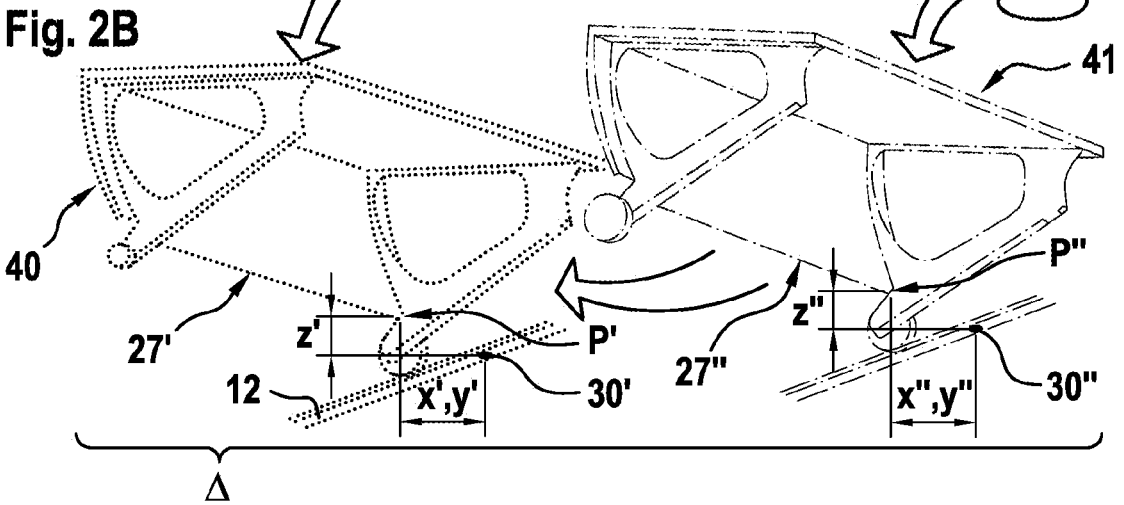
Figure 2C:
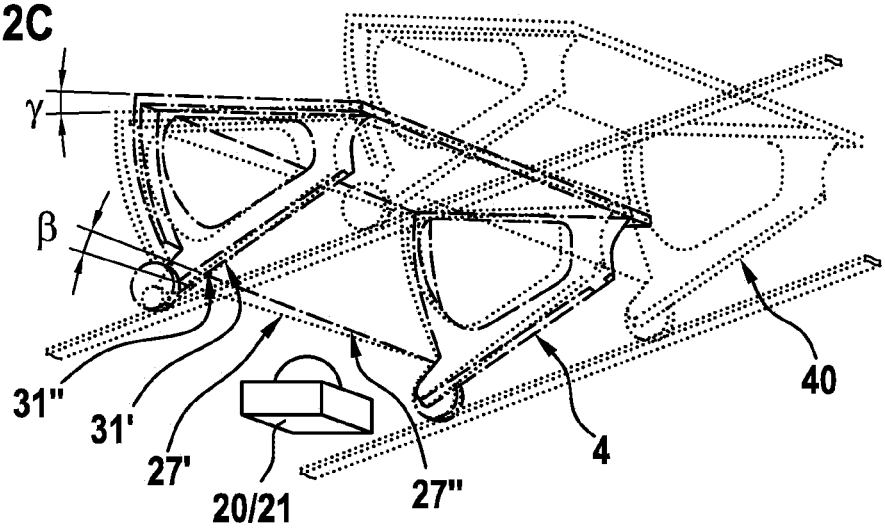

FIG. 2 schematically shows in the detail FIGS. 2A to 2C the main method steps of the method according to an embodiment of the present disclosure that can be carried out by the detecting device 20.

As already shown in FIG. 1, the image capturing device 21 of the detecting device 20 in FIG. 2A is also arranged stationarily in relation to the guide rails 12 between the forward travel 14 and the non-illustrated return travel. The image capturing device 21 has a hemispherical transparent protective cover 23. In order to periodically clean the latter from dirt and dust, a cleaning device 18 is provided, which, in the present example, is illustrated as a compressed-air blowgun.

FIG. 2A further illustrates a section of the revolving band 10, more precisely, two tread elements 9 of the step band 10. One of the two tread elements 9 has lost a drag roller 13 thereby causing an incline of the tread surface 29 thereof.

Figure 3:
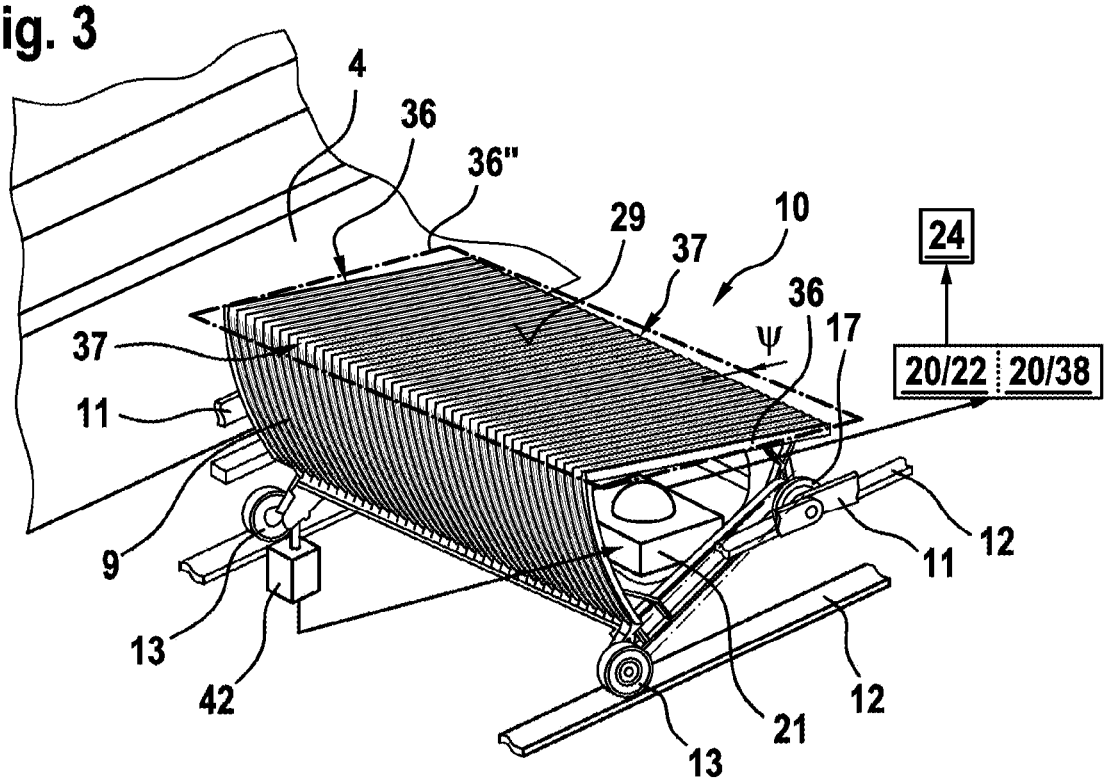
FIG. 3 shows an escalator step as a section of the revolving band, based on which an incline relative to the intended position is illustrated.

For reasons of clarity, the illustration of the conveyor chains 11 arranged on both sides of the tread elements 9 and of the step axles 26 connecting them as well as of the guide rails 12 supporting the conveyor roller 42 has been omitted (these components are shown in FIG. 3). The drag rollers 13 of the tread elements 9 are guided on the two illustrated guide rails 12. One of the guide rails 12 has a reference mark 30, which can also be detected by the image capturing device 21. Since the image capturing device 21 is always arranged stationarily at the same location, position balancing between the reference mark 30 and the image capturing device 21 is not required. However, when preparing the spatial image, the tread element 9 moves relative to the guide rails 12 and the image capturing device 21, which is the reason why here a position balancing and an assignment, respectively, represented by spatial coordinates x, y, z, is required. This can be carried out via the reference mark 30, as described below.

In FIG. 2B, a spatial image 40 of a tread element 9 of the section of the step band 10 shown in FIG. 2A is schematically illustrated by means of dotted lines and image points, respectively. Furthermore, a corresponding virtual space 41 is illustrated by means of dotdashed lines. The spatial image 40 is prepared by the image capturing device 21 which can be, for example, a laser scanner or a time-of-flight-camera. These image capturing devices 21 generating digital images 40 detect three-dimensional structures and image surfaces and edges thereof through a plurality of image points P', wherein each image point P', extending from a virtual zero point, is defined by spatial image coordinates x', y', z' and vector coordinates, respectively.

Stationary components can also be imaged at the same time. In the present example, a portion of the guide rails 12 and the reference mark 30 provided on the guide rail 12 as reference mark image 30' were imaged at the same time. The previously described virtual zero point can be the center of the reference mark image 30', for example.

The spatial image 40 is transmitted to the processing unit 22 (see FIG. 1). In the processing unit 22, at least one region 27' of the spatial image 40 is now selected, for example, the image of the riser bottom edge 27 of the tread element 9. The selection is made according to criteria stored in the processing unit 22, for example, based on regions in which a maximum deviation from its original or intended position is to be expected in case of wear or damage.

The processing unit 22 retrieves from an electronic data storage 39 an assigned comparison region 27". The latter is, for example, a portion of the virtual space 41, which can be retrieved from the data storage 39 and is defined by virtual coordinates x", y", z", and the surfaces and edges of which correspond to a spatial image, changed by limit values, of a section of the revolving band 10 in an original position. To be considered as the original position is the initial condition of this section before it shows a change in position due to wear, damage and contamination. In the virtual space 41, there is a virtual reference mark 30 ". The virtual space 41 illustrated in FIG. 2B serves only as an example of what may serve as a comparison region 27". Thus, for example, the entire illustrated virtual space 41 can be used as a comparison region 27". However, it may also be the case that only individual edges 27 or surfaces of a tread element 9, spatially extended by limit values, are stored in relation to the virtual reference mark 30" as comparison region 27". Of course, other components of the revolving band 10 can also be imaged in the comparison region 27".

Moreover, the spatial image coordinates x', y', z' between the reference mark image 30' and a clearly identifiable point, for example, a point P of the riser bottom edge 27 or, respectively, of the detected image point P' of the selected region 27' can be determined in the processing unit 22. If, at the time of preparing the spatial image, the point P of the tread element 9 has the spatial coordinate x, y, z relative to the reference mark 30, logically, the spatial image coordinates x', y', z' of the image point P' imaged on the spatial image 40 relative to the reference mark 30', which is also imaged, are identical to the spatial distance coordinates x, y, z. Ideally, clearly identifiable points P are selected.

When a spatial image 40 is made by the image capturing device 21 at an arbitrary point in time, it would be purely accidental if the selected region 27' of the spatial image 40 has the exact same spatial image coordinates x', y', z' relative to the reference mark image 30' as the corresponding comparison region 27" relative to the virtual reference mark 30". Thus, in a first step, an assignment of a selected region 27' to a corresponding comparison region 27" is made.

More precisely, a spatial position difference 4, for example, of the image point P' relative to the virtual point P" corresponding thereto of the corresponding comparison region 27" has to be calculated with the aid of the reference mark image 30' and the virtual reference mark 30", and the coordinates of the image points P' of the selected region 27' have to be converted with the aid of the calculated position difference 4. Possible optical distortions due to the spatial image 40 prepared in a point-symmetric manner have to be considered as well. According to the previously described assignment, for example, the spatial image 40 of the tread element 9 of a new and unloaded step band 10 is almost congruent with the virtual space 41, and the selected region 27' with the assigned comparison region 27", respectively. It is almost congruent because the comparison region 27" is always larger by limit values than the assigned selected region 27'.

In a second step it can be determined whether or not the image points P' of the selected region 27' are still within the assigned comparison region 27".

This comparison is schematically illustrated in FIG. 2C. Through the assignment, the comparison region 27" and the selected region 27' are overlapping one another and the largest deviations can now be determined. In the present example, the spatial image 40 of the tread element 9 deviates from the virtual space 41 in an impermissible manner, illustrated by the angles β and γ. Since the riser bottom edge 27 of the tread element 9 selected as the selected region 27' has an impermissible angular deviation β, the detecting device 20 generates an alarm signal for the attention of the controller 24, which stops the revolving band 10 immediately and keeps it in place. As can clearly be seen, some regions of the spatial image 40, for example, the bottom edge of the side cheek 31' of the spatial image 40, project beyond the assigned comparison region 31". Accordingly, this bottom edge of the side cheek 31' could also have been selected. The more regions 27', 31' of a spatial image 40 are selected and are compared with the comparison regions 27", 31", which are clearly assignable, that means, are equivalent in terms of their contour but not necessarily in terms of their position, the more precise can deviations and thus technical problems of the moving band 10 be detected.

FIG. 3 shows a tread element 9 as a section of a revolving band 10. Although the tread surface 29 of the tread element 9 is aligned horizontally, this tread surface has an incline which is shown exaggerated in FIG. 3 and is illustrated by the angle ψ. A possible cause for this incline relative to the intended direction of movement may be irregular signs of wear on the conveyor chains 11 which results in conveyor chains 11 of different lengths. An incline of the tread element 9 may result in an increasing gap between the adjoining balustrade base 4 and the side edge 36 of the tread surface 29 and thereby impermissibly facilitating of objects or limbs of the user getting trapped. In order to detect the incline, the side edges 36 and transverse edges 37 of the tread surface 29 captured on the spatial image 40 can be selected, the corresponding comparison region 36' can be assigned via the non-illustrated reference point image and the sides edges and transverse edges can be compared therewith.

Based on the example of FIG. 1 it is apparent that the side edges 36 and transverse edges 37 and, respectively, the selected region with the images of these side edges 36 and transvers edges 37, do not yet extend beyond the predetermined limits of the comparison region 36". However, some locations of the side edges 36 and transverse edges 37 are already close to these limits of the of the comparison region 36". Preferably, the detecting device 20 comprises an electronic processing unit 22 with an analysis unit 38. By means of the analysis unit 38, the position of surfaces or edges of the selected region relative to the limits of the comparison region 36" can be analyzed and a positional reserve ψ or, in the present example, the angle ψ of the incline can be determined. Based on the determined positional reserve ψ and/or by an analysis of a history of a plurality of previously determined stored positional reserves ψ or angles ψ, the next maintenance date can be determined. Thereby, imminent damages which can be the reason for serious consequential damages are detected early and their development is monitored.

From a positional reserve ψ that is classified by the analysis unit 38 as being maintenance-relevant, the work steps likely to be carried out and the maintenance material likely to be needed for maintenance, in the present example the conveyor chains 11 including their chain rollers 17, can be determined. Optionally, this can also be carried automatically, for example, by the analysis unit 38.

The sag 28 of the handrail 5 illustrated in FIG. 1 can be monitored in exactly the same way. Here, the assigned comparison region is a tubular virtual space, the central longitudinal axis of which corresponds to the bend in this section of the handrail 5 that exists during start of operation. An excessively tensioned handrail 5 projects beyond the upper limit and an insufficiently tensioned handrail 5 projects beyond the lower limit of the assigned comparison region.

As already mentioned, a position determining device 42 arranged on fixed components of the escalator or the moving walkway can also be provided. It detects distinctive surfaces, edges or marks of a tread element 9 or of a handrail section of the revolving band 5, 10. In FIG. 3, a push switch is arranged as position determining device 42 on one of the guide rails 12. As soon as the axle of a drag roller 13 runs past the position determining device 42, the latter generates a trigger for triggering the image capturing device 21 depending on the current position of the captured surfaces, edges or marks relative to the position determining device 42. Thereby, the spatial images of tread elements 9 are prepared in almost the same position relative to fixed components as the guide rails 12. In other words, the spatial images actually show different tread elements 9; however, all of them have been captured at almost exactly the same spot in relation to the fixed components surrounding them. Thus, where applicable, a correction of distortions of the spatial images can be dispensed with and a comparison with the comparison region can be carried out directly after a completed position balancing via the reference marks.

A possible malfunction of the position determining device 42 is not really a problem because the necessary assignments and corrections can be made at any time through the reference marks. This increases the availability of the detecting device significantly and therefore also the availability of the escalator or the moving walkway.

Figure 4:
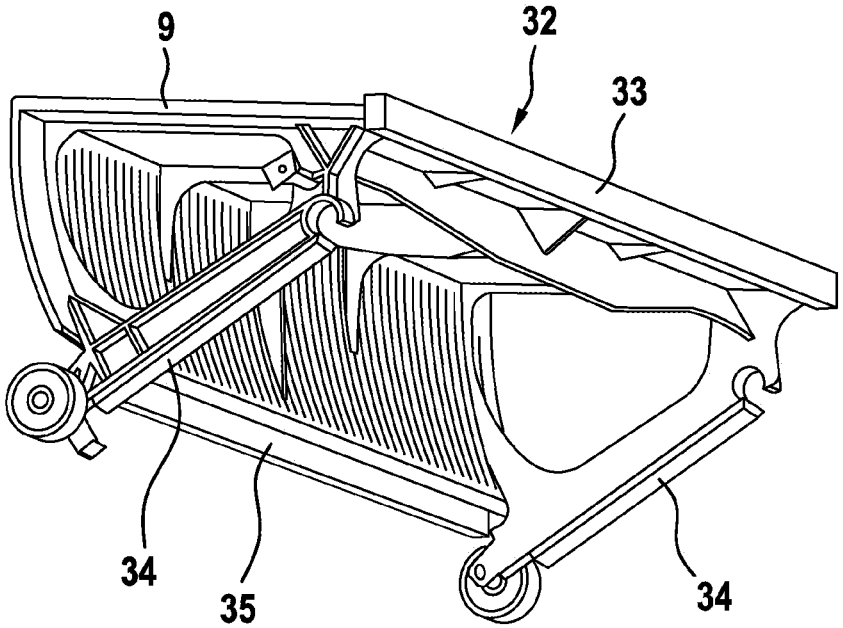
FIG. 4 shows a possible configuration of a bounding volume element suitable for a learning movement.

FIG. 4 shows a possible configuration of a bounding volume element 32 suitable for a learning movement. This bounding volume element 32 for example, is a normal tread element 9 on which the attachment parts 33, 34, 35 representing the limit values are attached. The bounding volume element 32 is now inserted in the revolving band 10 and moved to the image capturing device 21. The spatial image prepared by the image capturing device 21 also includes the reference mark image 30' described in FIG. 2 and can be processed by the processing unit 22, for example, by correcting distortions due to the point-symmetric imaging by the image capturing device 21. In order to reduce the amount of data and to save storage resources, only the contour lines of this processed spatial image may be stored in the data storage 39 as virtual space 41. Individual regions of this virtual space 41 can then be selected and stored as assignable comparison regions 27", 31".

Although the invention(s) has/have been described by illustrating specific exemplary embodiments, it is obvious that numerous further embodiment variants can be created in knowledge of the present disclosure, for example, by combining the features of the individual exemplary embodiments and/or exchanging individual functional units of the exemplary embodiments. For example, the laser scanner itself may be the position determining device, for example, by continuously monitoring a certain location of the space as to whether, for example, a clearly identifiable distinctive part of the body of an escalator step is momentarily present or not. The capturing time can also be triggered by means of the handrail; however, the latter has to be provided with a mark as the distinctive part of the body triggering the trigger. For reasons of better clarity, an illustration of signal transmitting means, power supply lines and the like has been largely omitted in the FIGS. 1 to 4. However, they must inevitably be present in order for the escalator comprising the monitoring device according to the disclosure to be employed without malfunction. Accordingly, correspondingly configured escalators are comprised by the scope of the present patent claims.

Finally, it should be noted that terms such as "including," "comprising," etc. do not exclude any other elements or steps and terms such as "a" or "one" do not exclude a plurality. Reference signs in the claims are not to be construed as limitation.

The invention claimed is:

1. A method for detecting and monitoring the mechanical condition of an escalator or a moving walkway with at least one revolving band and at least one detecting device, the method comprising:

creating at least one spatial image of at least one section of the revolving band, selecting at least one region of the spatial image, comparing the selected region with at least one comparison region, the comparison region being defined by three-dimensional coordinates and representing a virtual space that can be clearly assigned to the selected region, and generating an alarm signal if the selected region differs from the comparison region by surpassing predetermined limits, wherein the assignment of the comparison region to the selected region is carried out via reference marks which are assigned to fixed components of the escalator or the moving walkway, wherein the reference marks can be identified in the spatial image and in the corresponding comparison region.

2. The method according to claim 1, wherein at least one distinctive surface or distinctive edge of a tread element or a section of a handrail of the escalator or the moving walkway is selected as selected region of the revolving band.

3. The method according to claim 2, wherein the predetermined limits of the comparison region are surpassed when one or more of the following occur:

the selected region projects at least at one location beyond the virtual space;

the selected region is missing edges or surfaces; and edges or surfaces of the selected region, by surpassing a predetermined angular tolerance limit, are not arranged parallel to corresponding edges or surfaces of the virtual space.

4. The method according to claim 2, wherein a series of spatial images of the section of the revolving band is captured, and, by comparing the distances of surfaces and edges captured on the images to at least one reference mark image, the spatial image is selected which matches best the assigned comparison region and the virtual reference mark thereof, and at least one selected region of this spatial image is compared with the comparison region.

5. The method according to claim 1, further comprising providing a position determining device that is arranged on fixed components of the escalator or the moving walkway and which detects distinctive surfaces, edges or marks of a tread element or a handrail section of the revolving band and generates a trigger for triggering an image capturing device of the detecting device depending on the current position of the detected surfaces, edges or marks relative to the position determining device.

6. The method according to claim 1, further comprising:

analyzing, with an analysis unit, the position of surfaces or edges of the selected region relative to the limits of the comparison region; and determining a positional reserve; and based on the determined positional reserve or through an analysis of a history of a plurality of previously determined and stored positional reserves, the next maintenance date is determined.

7. The method according to claim 6, wherein, from a positional reserve classified by the analysis unit as being maintenance-relevant, the work steps likely to be carried out as well as the maintenance material likely to be needed for maintenance are determined.

8. The method according to claim 1, wherein, for generating and storing the comparison region, a learning movement with a bounding volume element representing the maximum permissible deviations is carried out and the spatial image thereof is stored in a data storage.

9. The method according to claim 1, wherein:

a learning movement is carried out with the revolving band intended for operation, a spatial image of a section of the revolving band is prepared, and a comparison region is generated from this spatial image by adding limit values in the form of three-dimensional coordinates to distinctive edges and surfaces of the spatial image.

10. The method according to claim 1, wherein, for checking the functionality of the detecting device, a test movement with at least one test element is carried out, wherein the test element is dimensioned such that it projects at least at one location beyond the comparison region.

11. An escalator or moving walkway comprising:

a band arranged in a revolving manner;

at least one detecting device for detecting and monitoring a mechanical condition of the escalator or the moving walkway, wherein the detecting device comprises at least one image capturing device configured to generate spatial images, wherein the condition of the revolving band and/or the arrangement of sections of the band relative to fixed components of the escalator or the moving walkway can be detected by the detecting device in that at least one spatial image of a section of the revolving band is generated, distinctive surfaces or edges of the section captured on this image are selectable by a processing unit of the detecting device and are comparable with a three-dimensional comparison region stored in a data storage, wherein that the comparison region can be assigned to the selected region via reference marks, wherein the reference marks are assigned to fixed components of the escalator or the moving walkway and wherein the reference marks are identifiable in the spatial image as well as in the corresponding comparison region.

12. The escalator or moving walkway according to claim 11, wherein the escalator or moving walkway further comprises a position determining device which is arranged on fixed components of the escalator or the moving walkway and through which distinctive surfaces, edges or marks of a tread element or a handrail section of the revolving band can be detected, and through which a trigger for triggering the image capturing device can be generated depending on the current position of the detected surfaces, edges or marks relative to the position determining device.

13. The escalator or moving walkway according to claim 11 wherein the detecting device is arranged between a forward travel of the revolving band and a return travel of the revolving band.

14. The escalator or moving walkway according to claim 11, wherein the image capturing device comprises a transparent protective cover and the detecting device has a cleaning device by which at least a partial surface of the transparent protective cover is cleaned periodically.

* * * * *